United States Patent [19]

Camardella

[11] 4,185,789

[45] Jan. 29, 1980

[54] STRUCTURE OF A MULTIPLE WIREGUIDE

[75] Inventor: Giuseppe Camardella, Saronno, Italy

[73] Assignee: Tekma Kinomat S.p.A., Caronno Pertusella, Italy

[21] Appl. No.: 852,526

[22] Filed: Nov. 17, 1977

[30] Foreign Application Priority Data

Nov. 4, 1976 [IT] Italy ..... 29697 A/76

[51] Int. Cl.[2] ..... H01F 41/06

[52] U.S. Cl. ..... 242/7.11; 242/7.14

[58] Field of Search ..... 242/7.11, 7.09, 7.14, 242/53; 140/92.1

[56] References Cited

U.S. PATENT DOCUMENTS

| | | | |
|---|---|---|---|
| 2,855,159 | 10/1958 | Mallina | 242/7.11 X |
| 3,402,903 | 9/1968 | Camardella | 242/158.5 |
| 3,410,317 | 11/1968 | Rondas | 242/7.09 |
| 3,658,269 | 4/1972 | Camardella | 242/7.11 |
| 4,020,996 | 5/1977 | Deeg | 242/7.11 |

*Primary Examiner*—Billy S. Taylor

*Attorney, Agent, or Firm*—Young & Thompson

[57] ABSTRACT

A multiple wire guide for coil winding machines, said wire guide being made to rotate about its axis and to slide along its axis, comprising a plurality of individual wire guides fixed on a rectilinear connecting rod support and equally spaced from one another, said rod support being mounted on two synchronously rotatable eccentric pins, the eccentricity of which may be adjusted.

6 Claims, 5 Drawing Figures

73
79
16
3
14
73
77
77
77
32
34
35
37
4
5
36
8
1
30
27
28
F
35
37
4
5
36
9
2
10
12
38
23

40
40
40
40
69
3
16
35
35
51
49
40
53
45
10
46
12
23
54
47
55
56
31
31
31
31
67
58
50
57
4
5
52
30
27
59
63
65
60
63
66
42
61
43
62
41
44
12
10
23
11
28
29

REELING MACHINE FOR FORMING A HANK

The invention relates to reeling machines wherein hanks are formed on a rotating reel from spools of yarn guided by a rotary grooved or reciprocating guide for distributing the yarn over the reel, to obtain hanks most adapted for undergoing subsequent treatment, a lifting-guide being provided along the path travelled by the yarn. The invention also relates to hanks obtained by means of the reeling machine.

Difficulties constantly arise in manipulating a hank of yarn during the various required processes such as dyeing, drying and, more particularly, rewinding thereafter. The reason is that after the first two operations (dyeing and drying), the re-winding operation presents serious difficulties since the coils of yarn have mixed to some extent and rolled on top of one another, resulting in tangling, breaks or stoppages, at a frequency which substantially reduces output and increases the cost of the yarn.

Attempts have already been made to obviate these disadvantages by designing appropriate hank-reeling systems.

There are two kinds of hank known in the prior art, the diametric hank, in which various layers of yarn convolutions of the same width are parallel to the hank axis and are placed one on another radially, and the axial hank or skein in which the yarn layers overlap obliquely relatively to the axis and advance parallel thereto. Thus, a diametric hank comprises various layers of yarn convolutions of the same width which are parallel to the hank axis, and are placed one on another radially while an axial hank or skein is one in which the yarn layers overlap obliquely relatively to the axis and advance parallel thereto. The diametric hank takes the form of a large cylindrical annular member or ring. Thus, the term "differential diametrical winding machine" relates to a reeling machine for forming such diametrical hanks, the machine being arranged to form a hank with yarn layers of varying lengths. The conventional manner of forming diametric hanks, has a defect in that the outer edges of the hank are higher than the centre, so that the hank cross-section is concave along an axial plane. This excess thickness at the edges is due to the inertia of the yarn, which has a lower axial speed at the edges of the hank in spite of all the improvements made to the thread-guides. This fault occurs irrespective of the nature of the thread-guide used to form the coils rolled on to the hank holder i.e., whether the guide is a rotary drum guide, or is grooved or reciprocating.

The extra load of material on the edges of the hank make it difficult to handle, since the coils easily tangle and the yarn felts during the various handling operations.

To obviate this disadvantage, various other kinds of hank reeling have been devised, e.g. adding a lifting-guide between the thread-guide and the hank holder, the yarn moving over a convex lifting-guide such that the coils of the hank can be more accurately reeled, thus substantially eliminating the previously-mentioned drawback. Applicant's French Pat. No. 2,123,572 describes a device of this kind.

In another system, a flat hank is similarly manufactured by differential control of a reciprocating thread-guide, so that the previously-mentioned defect can be obviated by slight acceleration at the ends of the hank. A device of this kind has been described inter alia in French Pat. No. 1,419,288. This device has not been entirely satisfactory.

To increase production, it has become necessary to thicken the hank, and the aforementioned defect increases dangerously in proportion. Accordingly, a novel hank system called an "axial hank" or "sectional hank" has been devised, in which the coils of yarn, instead of being superposed over a single constant thickness with respect to the hank so that the hank becomes thicker in the radial direction only, are superposed over a constant width slowly moving in a direction parallel to the hank axis. The resulting hank has two bevelled edges and a cylindrical central part. In other words, the hank has a trapezoidal cross-section along an axial plane. This feature has the advantage of providing heavy hanks without the previously-mentioned disadvantages, but has the drawback of requiring a large surface in order to obtain a considerable amount of yarn. In other words, the hank is very wide, since instead of reeling a considerable weight of yarn by increasing the thickness of the hank, the same weight of yarn is reeled by increasing the width of the hank, which has the disadvantage of taking up considerable room on the reel and increasing the time and difficulty of dyeing operations and other treatment.

In addition, a convex-shaped hank of yarn has been obtained by constant, reciprocating lateral motion of the thread-guide with respect to the hank drum or reel. In the hank cross-section, the coils of yarn are progressively moved once to the right and once to the left. This kind of hank is described in French Pat. No. 839,685, in which the hank has a convex axial cross-section. To judge from the hank cross-section, it is likely that the aforementioned method, instead of improving the performance of the entire hank, will make it easier to displace it, even though it has the advantage of eliminating the previously-mentioned drawback by replacing the concave shape by a convex shape. In addition, in the aforementioned kind of hank, the weave length of the turns is constant.

A diametrical conical hank has the shape of a frusto-conical ring of yarn, in contrast to conventional diametrical cylindrical hanks, the shape of which resembles a cylindrical ring of yarn. The conical hank enables the yarn to be run-off at high speed after dyeing; however, if there is an excessive load of material at the axial ends of the hank, the coils of yarn tend to become mixed, with the result that bundles of yarn are taken up when the yarn is wound, from the hank, at high speed in the direction of the hank axis.

The hank perimeter may vary, depending on the distance between the top and bottom bars of the dyeing cabinets, which are used for holding and retaining the hanks. Consequently, when a hank is formed on a small drum or reel perimeter, the distance between the drum or reel and the thread-guide or lifting-guide is greater than when a large-perimeter hank is formed on the same drum or reel, since the drum diameter has decreased. It is also known that it is now conventional for the diameter of perimeter of the drums or reels to be easily variable on reeling machines.

Furthermore, if the arms of the reel on which the hank is formed are smooth, the yarn may slide when laid on the hank-bearing arms, with the result that the weave or interlacing of the yarn resulting from the reciprocating motion of the thread-guide does not so accurately reflect the thread-guide motion. This inaccuracy remains even when there is an additional lifting-guide.

The invention obviates the aforementioned disadvantages.

According to the invention, the reeling machine is characterised in that it comprises a lifting-guide having a variable active cross-section disposed at the optimum distance from the thread-guide and the reel.

According to another feature of the reeling machine, it comprises means for adjusting the position of the thread-guide and lifting-guide support relative to the reel axis, so that the distance between the lifting-guide and the reel periphery is maintained at the constant optimum value, irrespective of the reel perimeter.

In general, the lifting-guide having a variable active cross-section is disposed between the thread-guide and the reel and is actuated in synchronism therewith. Advantageously, the lifting-guide having a variable cross-section is rotatable and comprises bars having the desired cross-section and disposed around a rotating core having its axis parallel to that of the reel and of the thread-guide, a reduction gear actuating the lifting-guide in accordance with the motion of the reel and the thread-guide.

In order to construct hanks having variable perimeters, the thread-guide and lifting-guide are mounted on a holder which can move with respect to the reel so as to adjust the distance relative thereto, means being provided for moving the thread-guide and the lifting-guide irrespective of the position of the holder with respect to the reel. Advantageously the movable holder oscillates around a horizontal shaft disposed longitudinally at the base of the winder.

The reeling machine according to the invention is adapted for constructing diametrical cylindrical or conical hanks, i.e. wherein the coils of yarn are successively distributed on top of one another in a direction perpendicular to the bars of the cylinder on to which the hank is formed, whether the bars are parallel or conically inclined to the reel axis.

The reeling machine according to the invention can be used to form a hank having ends somewhat thinner than the centre. This is a novel advantage since, when the hanks are placed on the dyeing bars, it is conventional for the hanks to be made to overlap slightly by pressing them against one another, to prevent the dye from travelling along preferential paths. The slight reduction in the thickness of the ends also prevents overloading of yarn at the place of contact between hanks in the dyeing cabinet, and thus improves their homogeneity and uniformity of dyeing.

Furthermore, the slightly trapezoidal shape of the hank, in axial section, has the advantage of substantially eliminating any felting during dyeing of the coils of yarn disposed at the two ends of the hank, which facilitates re-reeling the hank either during run-off, i.e. reeling the hank in a direction parallel to its axis, or during unreeling, i.e. by rotating the hank and its holder in the yarn unreeling direction.

The invention will now be described by way of example with reference to the accompanying drawings in which.

Figure 4:
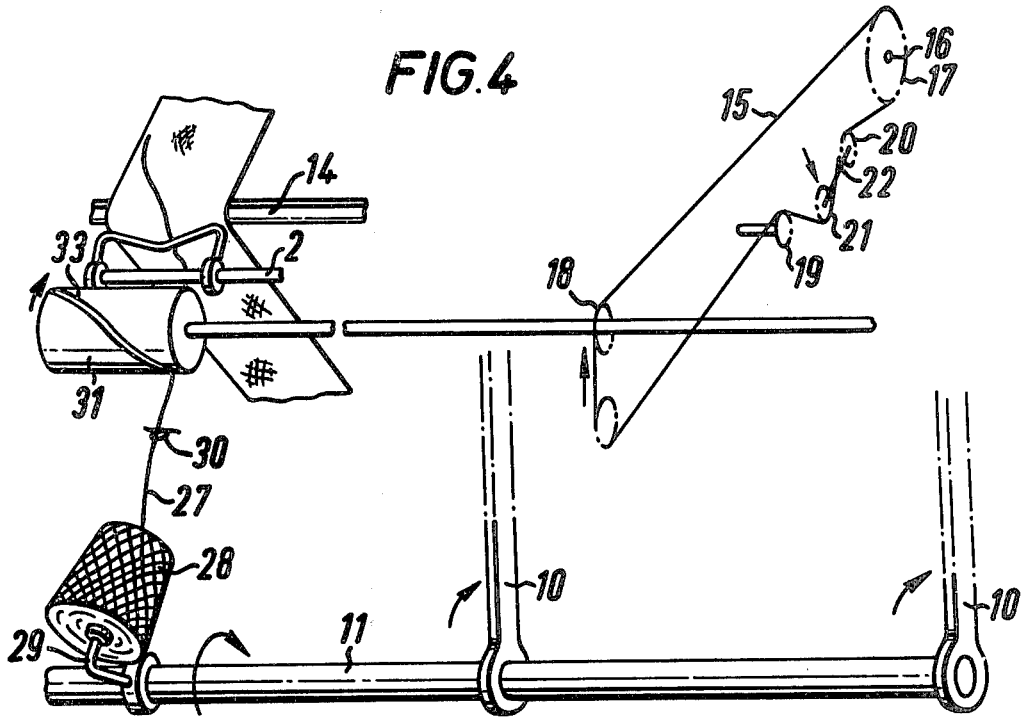
Figure 5:
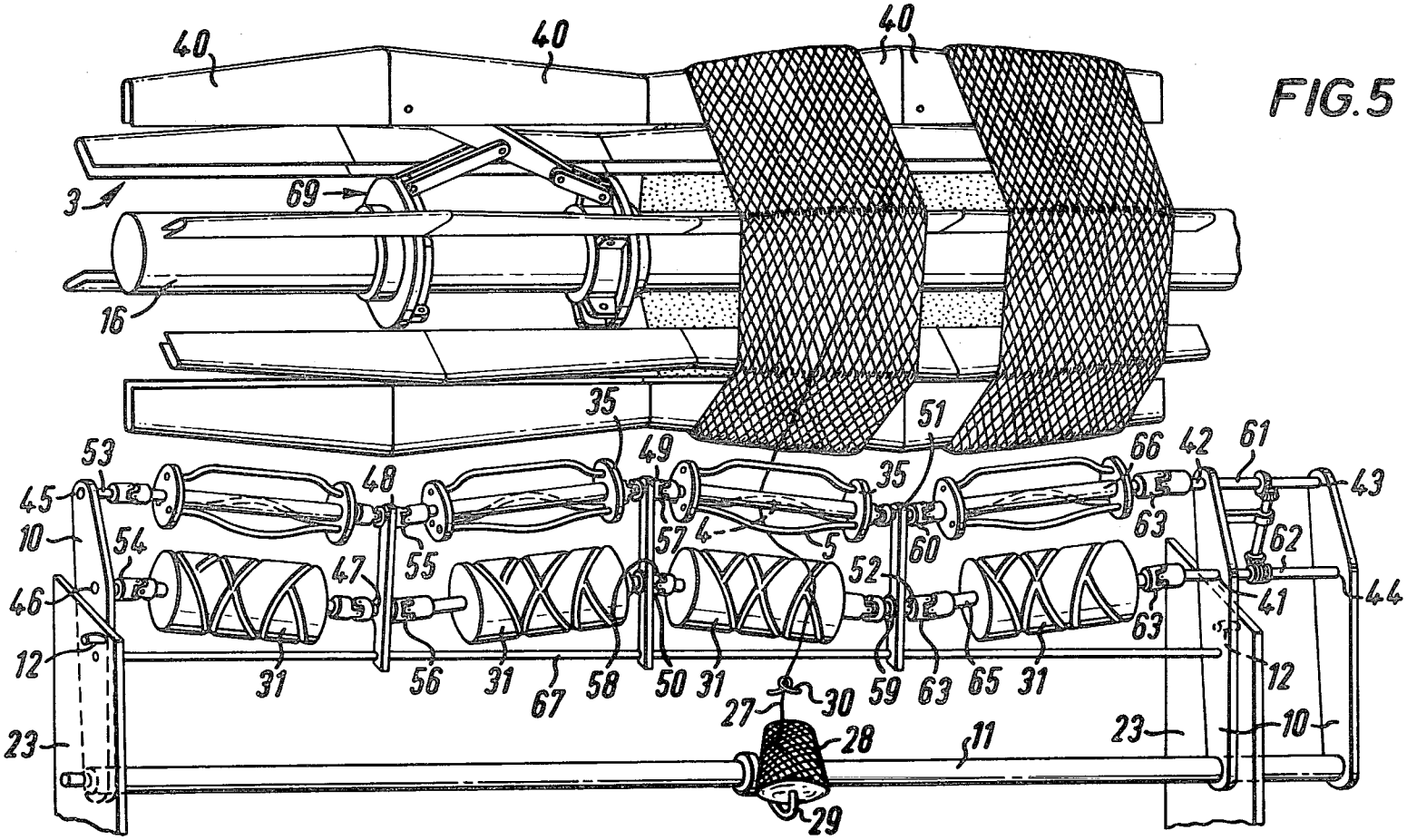
FIG. 5 is a diagrammatic perspective view of the reeling machine according to the invention, applied to conical diametrical hanks; and, FIGS. 6 and 7 are two cross-sectional views of the reel, i.e. when the conical or cylindrical hank is wound and when it is taken off.

In the reeling machine, a yarn 27 coming from a cone 28 placed on a holder 29, FIG. 5, secured to a bar 11 enters a wire thread-guide 30, a thread-guide 31 (FIGS. 3 and 4) or a drum 32 (FIG. 1) keyed to a shaft 1, and winds on to a reel 3 bearing hanks 73 and rotating on a shaft 16. Actually, yarn 27 enters a groove 33 of thread-guide 31 or a groove 34 of drum 32 before travelling on to a lifting-guide 35 disposed between shaft 1 and reel 3. Guide 35 has a variable active cross-section. It is made up of two end discs or flanges 36, 37 secured to shaft 2 and bearing rods. The drawing shows a very convex lifting-guide 4 and a concave lifting-guide 5. Shaft 1 rotates on bearings 8 whereas shaft 2 rotates on bearings 9, the bearings being secured to a holder 10 which can tilt, towards or away from the reel 3, around a shaft 11 secured in frames 23 and carrying the holder 29. Holder 10 includes a slat 12 in the form of a button-hole concentric with shaft 11, so as to adjust the relative angular position of holder 10 in the frames 23 and secure it by a nut 38.

Figure 3:
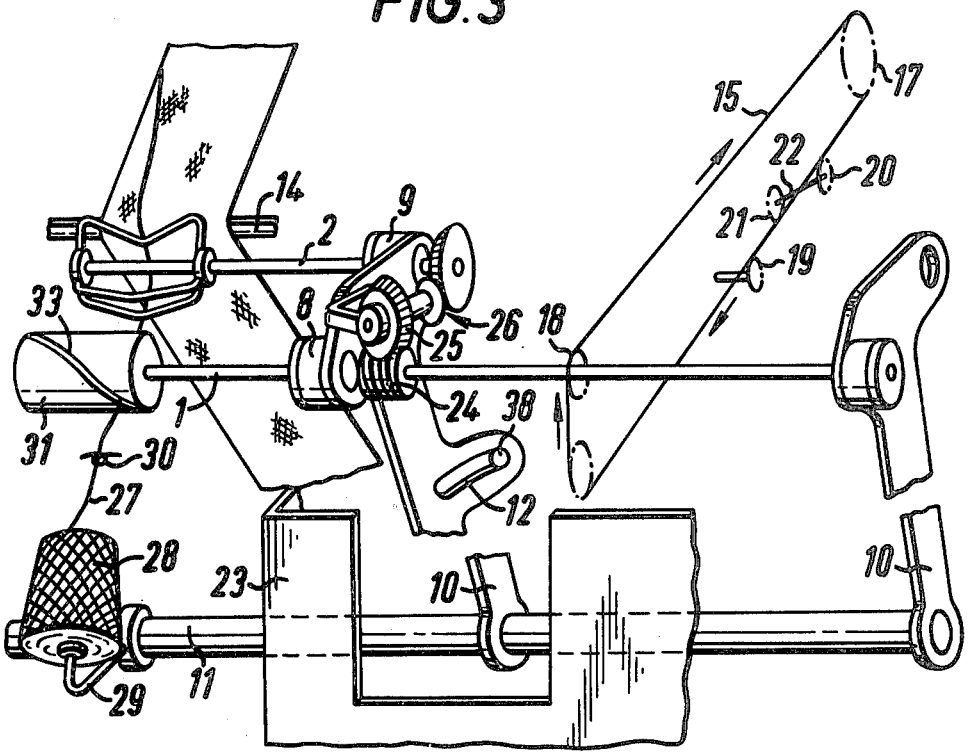
FIGS. 3 and 4 are two diagrammatic perspective views of the reeling machine according to the invention in two extreme positions relative to hanks having different perimeters.

The reel 3 bearing the hanks 73 rotates on its shaft 16 and comprises holding bars 14 which can move perpendicular to shaft 16, depending on the desired hank periphery. Shaft 16, FIGS. 3 and 4, is driven by a sprocket wheel 17 keyed thereto and a chain 15 connected to a sprocket wheel 18 secured to shaft 1. Since shaft 1 can move away from or towards shaft 16, depending on the adjustment of holder 10, a tensioning device for chain 15 is provided comprising a tightener 22 in the form of an oscillating arm, one end of which bears a sprocket wheel 21 which pushes the chain in to a loop between two sprocket wheels 19, 20 having stationary axes. Arm or holder 22 is resiliently driven so that it constantly forms the loop and tightens chain 15. Tilting of the holder 10 towards the reel 3, as shown in FIG. 4, causes the tensioning device to be operative so as to tighten the chain 15; tilting of the holder 10 away from the reel 3, as shown in FIG. 3, causes tightening of the chain 15 against the tensioning device. Thus, the lifting guide 35 may be maintained at a position immediately adjacent the hank being formed on the reeling machine. Shaft 2 is driven from shaft 1 by a reduction gear comprising an endless screw 24 keyed to shaft 1 to drive a wheel 25 which in turn actuates shaft 2 via a bevel gear 26.

Figures 1, 2:
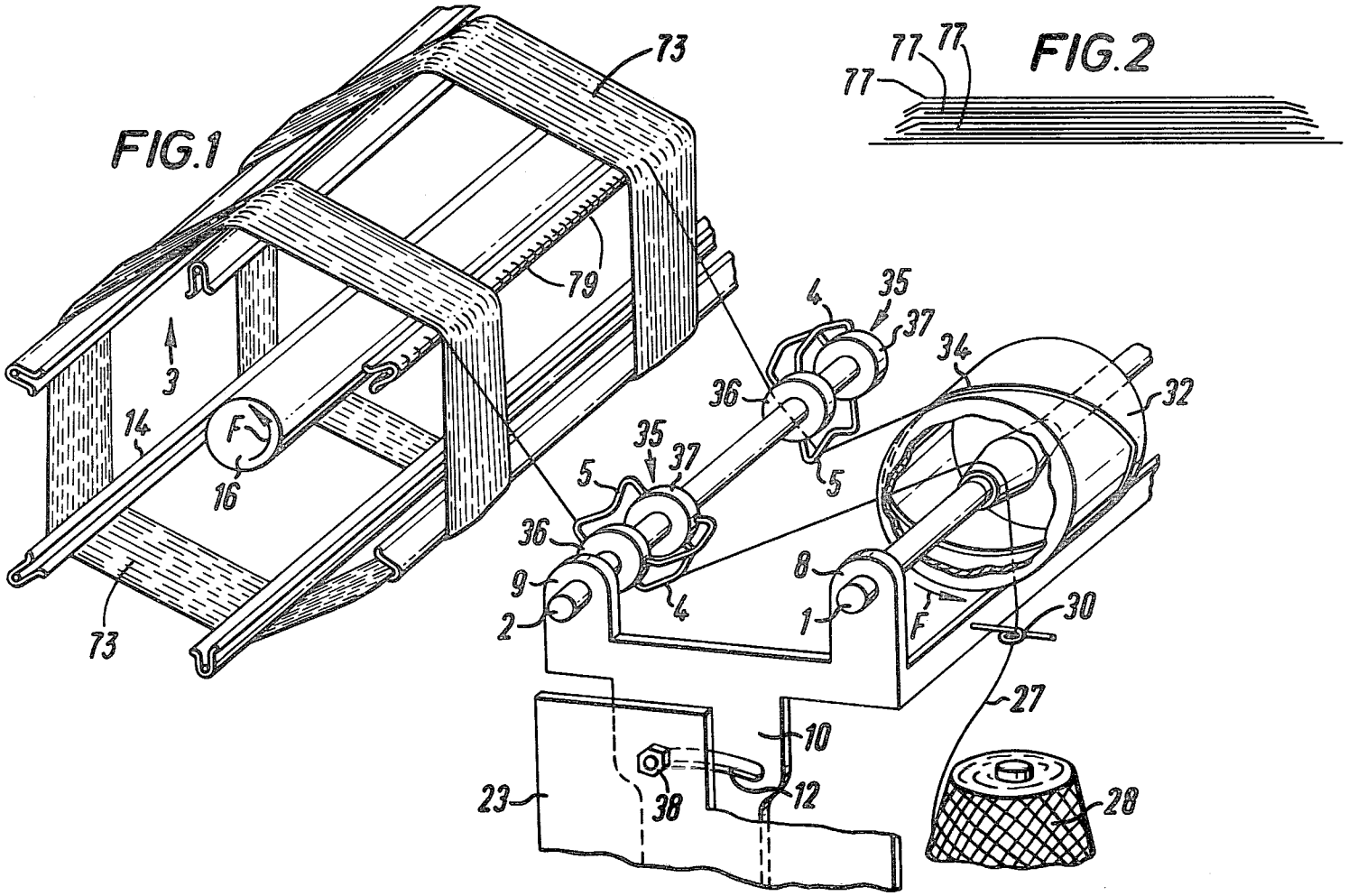
FIG. 1 is a diagrammatic perspective view of a reeling machine according to the invention for forming cylindrical diametrical hanks.
FIG. 2 is a section of a diametrical, cylindrical or conical hank, constructed on the reeling machine according to the invention, along an axial plane.

During operation, for a given reel rotational speed, when yarn 27 moves from thread-guide 31 or drum 32 to a convex lifting-guide 4, the axial distance between adjacent coils of yarn in a single layer is increased on reel 3. When, on the other hand, yarn 27 travels over a concave lifting-guide 5, the axial distance between adjacent coils of yarn in a single layer is reduced. This axial distance is referred to hereinafter as the weave width. The number and cross-section of the lifting-guides 4, 5 can be chosen so that the weave width of respective layers of yarns in the hank will give the required irregularity as shown in FIG. 2, thus, layers 77 have a shorter weave width than the remaining layers. In the embodiment shown in FIG. 1, convex V-shaped lifting-guides 4 and a concave V-shaped lifting-guide 5 are provided. Guides 4 are spaced at angular intervals of approximately 60° about the shaft 2; guide 5 is diametrically opposite one guide 4.

The efficiency of guides 4, 5 can be maintained, in spite of variations in the diameter of reel 3, by adjusting the angular position of holders 10 around shaft 11. The rotation of the lifting guide is correlated with the traverse of the yarn such that, as the yarn reaches or approaches an end of the traverse stroke, a guide 4 or 5 lifts the yarn so as to increase the yarn path from the traverse guide to the reel which results in a shorter traverse of the yarn across the reel. Thus, rotation of the lifting guides on shaft 2 will cause a hank to be formed having a thicker central portion in comparison to the end portions. It will be understood that the rotatable thread guide may be replaced by a reciprocable thread guide means to effect distribution of the yarn during the reeling.

The device has the advantage of giving a perfectly tied-up hank which is easier to manipulate and has a relatively trapezoidal cross-section as shown in FIG. 2. In FIG. 2, the shape of the axial edges of the layers have been exaggerated for the sake of clarity.

However, if it is desired to wind conical hanks on to a reel, the hank-bearing arms must be inclined to the reel axis and converge towards it (FIG. 5).

Furthermore, in order to form a number of hanks simultaneously on to a single reel, the arms must comprise trapezoidal components 40 which can be secured along each arm 14, so that the major bases of the trapezium are adjacent, and the same applies to the minor bases.

In that case, if the thread-guides 31 and lifting-guides 4, 5 have their axis 16 parallel to the reel axis, the distance between the lifting-guide and the large-perimeter part of the conical hank will be less than the distance between the lifting-guide and the smaller-diameter part of the conical hank. This disadvantage can easily be obviated by inclining the lifting-guides and thread-guides along two broken parallel lines so that their axis is parallel to the surface of the resulting hank, i.e. to the frusto-conical holder formed by the arms. To this end, it is merely necessary for the oscillating frames 10 to bear rigid bearings 41–52 supporting shafts 53–62 which end in universal joints 63 secured to the shafts 65, 66 of each thread-guide and lifting-guide pair.

The frames of bearings 47–52 are secured to a transverse bar 67 which in turn is secured to the pivoting end frames 10.

Thus, when frames 10 are pivoted, the thread-guides and lifting-guides all pivot simultaneously and move towards the reel, leaving an equal distance between each lifting-guide and the periphery of the conical hank.

In order to prevent the coils of yarn sliding when disposed on the reel arms, in the case where the hank is cylindrical or more particularly conical, it may be necessary to form transverse grooves 79 (see FIG. 1) on the tips of the reel arms 14, 40 in a direction perpendicular to the axis of the arms.

However, these grooves may cause trouble when it is desired to detach the finished hanks by sliding them along the grooved arms.

Figure 6:
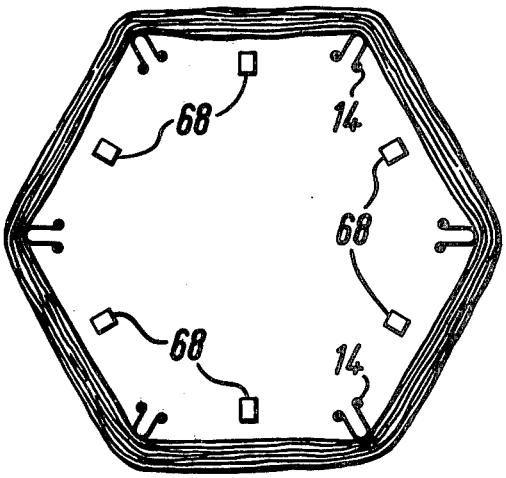
FIG. 6 shows the hank when wound and FIG. 7 shows the hank taken off, in the case of both conical and cylindrical hanks.

For this reason, according to another feature, a smooth stationary or adjustable arm 68 (FIGS. 6 and 7) parallel to the reel axis is disposed between each pair of adjustable reel arms.

Figure 7:
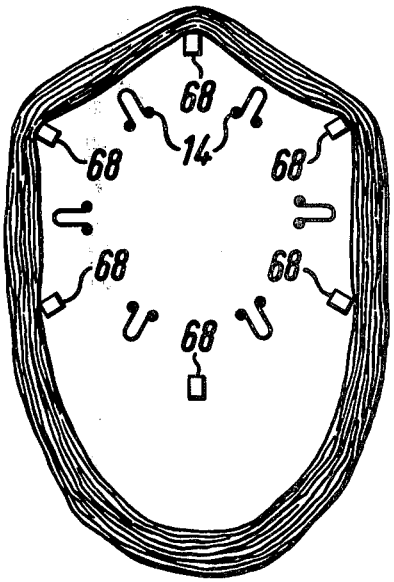

The smooth rectilinear arms 68 are disposed so that when the hank is being formed, they are radially retracted, relative to arms 14, for a sufficient distance from the mass of the hank to prevent interfering with the process of forming the hank on the reel (FIG. 6); when the winding arms 14 are withdrawn, the hank rests on arms 68, via known means shown at 69 in FIG. 5, so that the hanks can be extracted (FIG. 7).

Thus, the hanks normally slide on the intermediate smooth arms without their extraction being impeded by the grooves on the hank-bearing arms.

I claim:

1. A reeling machine for forming cylindrical or conical hanks from spools of yarn, said machine comprising a rotatable reel; traverse means for distributing yarn axially of the reel; and a lifting guide means to engage and lift the yarn from its normal path of movement as the yarn approaches an end of a traverse stroke to increase the yarn path from said traverse means to said reel so as to adjust the traverse of the yarn across said reel whereby a hank is formed with varying length yarn layers.

2. A reeling machine according to claim 1 wherein said traverse means comprise a rotatable thread guide means.

3. A reeling machine according to claim 1 wherein said traverse means comprise a reciprocable guide means.

4. A reeling machine according to claim 2, characterized in that the lifting guide means is disposed intermediate said thread guide means and said reel.

5. A reeling machine according to claim 4, comprising means to actuate the lifting guide means in synchronism with the reel and the thread guide means.

6. A reeling machine according to claim 5, wherein said reel comprises a plurality of arms, and wherein the lifting guide means is rotatable around an axis parallel to that of the thread guide means and to the outer surface of the hank being formed, i.e., to the outer surface of said arms holding the hank during winding.

7. A reeling machine according to claim 6, comprising a reduction gear in drivable connection with said reel and said lifting guide to effect actuation of said lifting guide means upon rotation of said reel.

8. A reeling machine according to claim 7, comprising means for adjusting the position of the thread guide means lifting guide means relative to the rotational axis of said reel, so that the distance between the lifting guide means and the reel periphery is maintained at a constant value irrespective of the reel perimeter.

9. A reeling machine according to claim 8, comprising a holder for the thread guide means and lifting guide means, said holder being movable and arranged to oscillate around a horizontal axis disposed longitudinally at the base of the machine.

10. A reeling machine according to claim 2, wherein said reel comprises hank forming means to form cylindrical or frusto-conical hanks of yarn.

11. A reeling machine according to claim 10, comprising two parallel broken lines of thread guide means and lifting guide means actuated so that the axes of successive thread guide means and lifting guide means are substantially parallel to the outer surface of the hank being formed.

12. A reeling machine according to claim 6, wherein the arms have transverse grooves for retaining the yarn, the machine including further fixed or extendable arms having a smooth rectilinear surface parallel to the reel axis, said further arms being disposed radially in a withdrawn position between said grooved arms holding the hank during the formation thereof, said further arms being disposed below the inner surface of the hank being formed and bear the mass of the hank when said further arms are retracted towards the centre of the reel.

* * * * *